US008100627B2

(12) United States Patent
Melo

(10) Patent No.: US 8,100,627 B2
(45) Date of Patent: Jan. 24, 2012

(54) PUMP WET END REPLACEMENT METHOD AND IMPELLER FIXING MECHANISM

(75) Inventor: Ricardo Abarca Melo, Santiago (CL)

(73) Assignee: Vulco, S.A., Santiago (CL)

( * ) Notice: Subject to any disclaimer, the term of this patent is extended or adjusted under 35 U.S.C. 154(b) by 591 days.

(21) Appl. No.: 11/643,014

(22) Filed: Dec. 20, 2006

(65) Prior Publication Data

US 2008/0152476 A1 Jun. 26, 2008

(51) Int. Cl.
*F03B 11/02* (2006.01)
*F01D 11/22* (2006.01)
*F01D 25/24* (2006.01)

(52) U.S. Cl. ..... 415/1; 415/128; 415/173.2; 415/174.1; 415/214.1

(58) Field of Classification Search ..... 415/128, 415/131, 132, 173.2, 173.4, 174.1, 174.4, 415/214.1; 29/889.1
See application file for complete search history.

(56) References Cited

U.S. PATENT DOCUMENTS 2,365,058 A * 12/1944 Crawford ..... 415/196
2,849,960 A * 9/1958 Olmstead et al. ..... 415/204
4,126,347 A * 11/1978 Hogue ..... 294/74
4,802,818 A 2/1989 Wiggins
4,913,619 A * 4/1990 Haentjens et al. ..... 415/172.1
5,941,536 A * 8/1999 Hill ..... 277/634
6,893,213 B1 * 5/2005 Quill et al. ..... 415/131
6,921,242 B2 * 7/2005 Blattmann ..... 415/1
7,074,017 B2 * 7/2006 Coray et al. ..... 417/360

FOREIGN PATENT DOCUMENTS

AU 602860 5/1985

* cited by examiner

*Primary Examiner* — Edward Look
*Assistant Examiner* — Sean J Younger
(74) *Attorney, Agent, or Firm* — Morriss O'Bryant Compagni

(57) ABSTRACT

An impeller fixing mechanism is provided in a centrifugal pump for immobilizing the impeller, relative to the pump shaft and drive shaft of the pump, while effecting repairs to the pump, thereby eliminating much of the labor-intensive need for realigning the pump shaft and drive shaft and assuring accurate positioning of the impeller relative to the pump shaft. A method for effecting repairs of centrifugal pumps employs use of the impeller fixing mechanism of the invention to immobilize the impeller relative to the pump shaft, thereby facilitating the repair.

5 Claims, 5 Drawing Sheets

PUMP WET END REPLACEMENT METHOD AND IMPELLER FIXING MECHANISM

BACKGROUND OF THE INVENTION

1. Field of the Invention

This invention relates generally to pumps such as, for example, centrifugal pumps of the slurry processing type, and specifically relates to a method for handling components of the pump to facilitate repair of pumps in a more efficient and cost-effective manner.

2. Description of Related Art

Centrifugal slurry pumps are used in a large variety of industrial processes, especially in the grinding and grading stage of ore during mineral processing. Ore slurries are highly abrasive causing great wear and tear to those parts of the pump in contact with the slurry, which requires slurry pumps to undergo frequent servicing.

In the processing of copper ore, a slurry pump typically processes approximately 2,000 tonnes of ore per hour, including about 20 tonnes of copper content. Depending on the slurry pump size and weight, which may range from 12 to 30 tonnes, replacement of a worn pump or its parts takes from eight to sixteen hours, and each replacement therefore causes a production loss of at least 150 to 300 tonnes of copper.

For that reason there have been advances in the design and development of slurry pumps to extend the pump operating time between services. One of the typical solutions is to protect the pump casing with metallic or elastomeric sacrificial internal liners. However, in the state of the art, there is no technical solution to reduce the period of time it takes to change out a slurry pump, this being the technical problem that the present invention addresses.

BRIEF SUMMARY OF THE INVENTION

In accordance with the present invention, an impeller fixing mechanism is provided for immobilizing and fixing the impeller in a centralized position during a procedure for effecting pump repairs which eliminates much of the cost and time expenditure that is normally encountered in effecting pump repairs. Also disclosed is a method for effecting centrifugal pump repair in a cost-effective manner.

Centrifugal pumps typically comprise a base, a casing or "wet end" as it may be referred to in the art, and a rotating impeller connected to a drive shaft. The wet end has a casing formed by two bolted halves with faces or surfaces inside the casing, and the two bolted halves form a housing in which an impeller, secured to the drive shaft, rotates. Sacrificial liners may also be used on the inside surfaces of the casing halves to protect the casing.

Wet end liner and impeller replacement is normally carried out by changing the complete pump or by dismantling the pump wet end in situ and removing the wet end liners and impeller component by component. To avoid vibration and prevent damage to the pump a precise realignment of the impeller and the drive shaft is necessary as part of the repair. Such a procedure during wet end liner and impeller replacement takes in excess of eight hours. This long period of time is the technical problem that is resolved by the present invention which incorporates an impeller fixing device that allows removal of the pump casing or wet end without disengaging the pump shaft from the coupling device which couples it to the drive shaft. Therefore it does not require shaft realignment or wet end dismantling in situ.

The impeller fixing mechanism of the present invention is comprised of two elements, each concentric with the pump shaft and positioned to abut against the inside surface of the casing faces. Preferably the fixing elements are annular in shape, having a diameter between 0.95D and 1D, where D is the impeller diameter. The two fixing elements each comprise a flexible elastomeric member and a stiff backing member. The stiff backing member incorporates a mechanism for loosening the mounting bolts and nuts to enable axial movement of the fixing elements toward the impeller to immobilize the impeller during repairs.

Preferably, the thickness of the elastomeric members is about 10 mm to about 25 mm. Each elastomeric member, however, can have a different thickness relative to each other. Preferably, the diameter of the stiff backing member is the same as that of the elastomeric members to be radially co-extensive therewith, and is formed by a flat annular plate having ribs. The flat plate thickness may be between about 10 mm and about 30 mm and the height of the ribs may be between 20 to 50 mm.

Preferably, the fixing mechanism tightening system comprises tightening bolts, which are screwed to the casing faces and abut against the rib or ribs of the stiff backing member, and the loosening system comprises loosening bolts, with nuts and washers. The loosening bolts freely pass through the casing holes and the bolts are jointly attached to the stiff backing member on the same rib where the tightening bolts are positioned to contact the fixing element. Preferably, the tightening bolts and loosening bolts are inserted therebetween and evenly spaced apart in a circumference concentric to the pump shaft.

According to another aspect of the present invention there is provided a procedure for replacement of the liners and impeller in a centrifugal pump which presents a savings of time and cost in effecting repairs to the pump. These and other features of the present invention are described more fully below.

BRIEF DESCRIPTION OF THE SEVERAL VIEWS OF THE DRAWINGS

In the drawings, which currently illustrate the best mode for carrying out the invention.

DETAILED DESCRIPTION OF THE INVENTION

Figure 1:
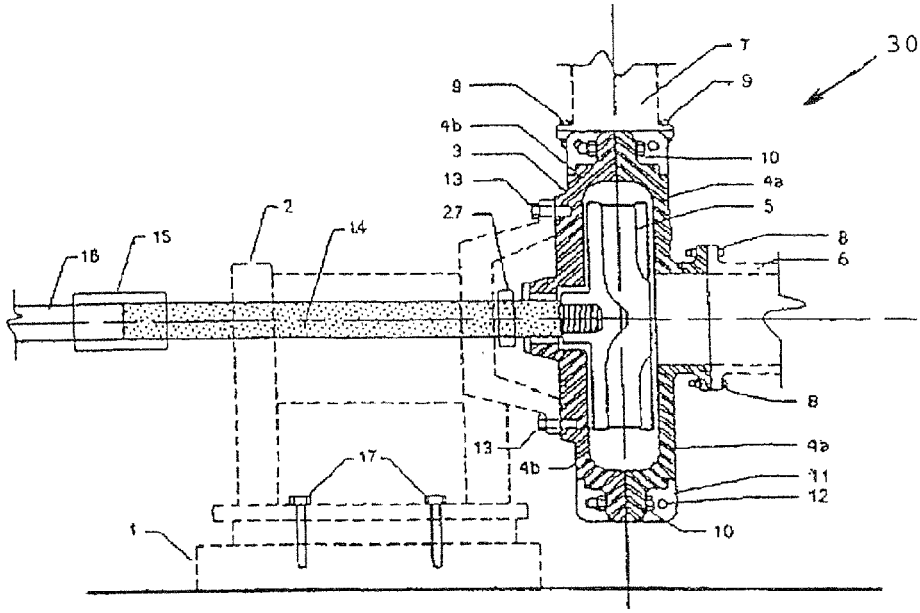
FIG. 1 (Prior Art)
FIG. 1 is a cutaway view in elevation of a slurry pump without a sacrificial liner, shown for comparative purposes.
Figure 2:
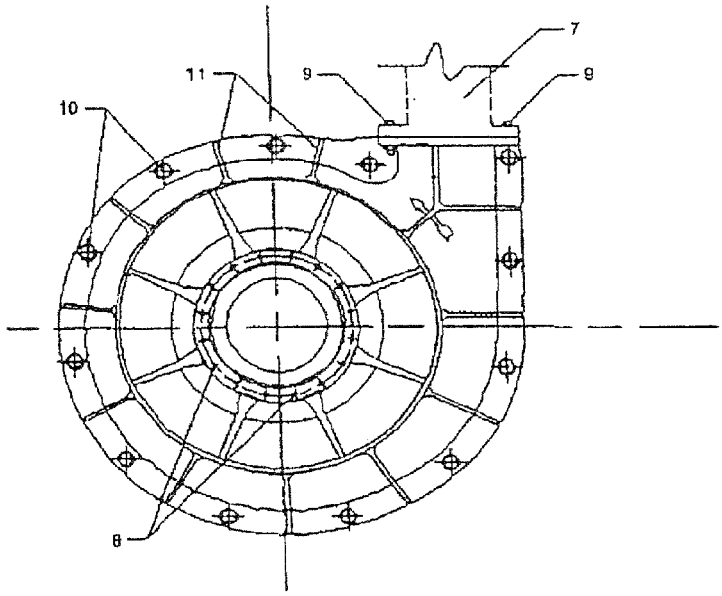
FIG. 2 (Prior Art)
FIG. 2 is a view in elevation of the front face (i.e., suction side) of the pump shown in FIG. 1.

FIG. 1 shows, for comparison purposes, a slurry pump assembly without liners. The pump assembly generally comprises a base 2 that is connected to subbase 1 by means of bolts 17. Subbase 1 is anchored to the ground. Base 2 supports the slurry pump 30, which consists of a casing 3, otherwise referred to herein as the "wet end" in accordance with the term used in the art, and a rotating pump shaft 14 with a torque release mechanism 27. The pump shaft 14 is connected by means of coupling 15 to the drive shaft 16. Wet end 3 further comprises a metallic casing formed by two members, the casing frontal face 4*a* and the casing rear face 4*b*, corresponding to the suction side and drive side of the pump, respectively. The frontal face 4*a* and rear face 4*b* are connected to each other by bolts 10. Frontal face 4*a* is connected to the inlet or suction pipe 6 by means of bolts 8.

The casing, or wet end 3, is fixed to base 2 by bolts 13 that are located in the rear face 4*b*. On the inside of the wet end is impeller 5 which is secured to the pump shaft 14 for rotation thereby. The slurry enters through inlet pipe 6 under the suction produced by the rotating impeller 5 and is propelled from the pump via outlet pipe 7, which is connected to the slurry pump 30 by bolts 9.

Figure 3:
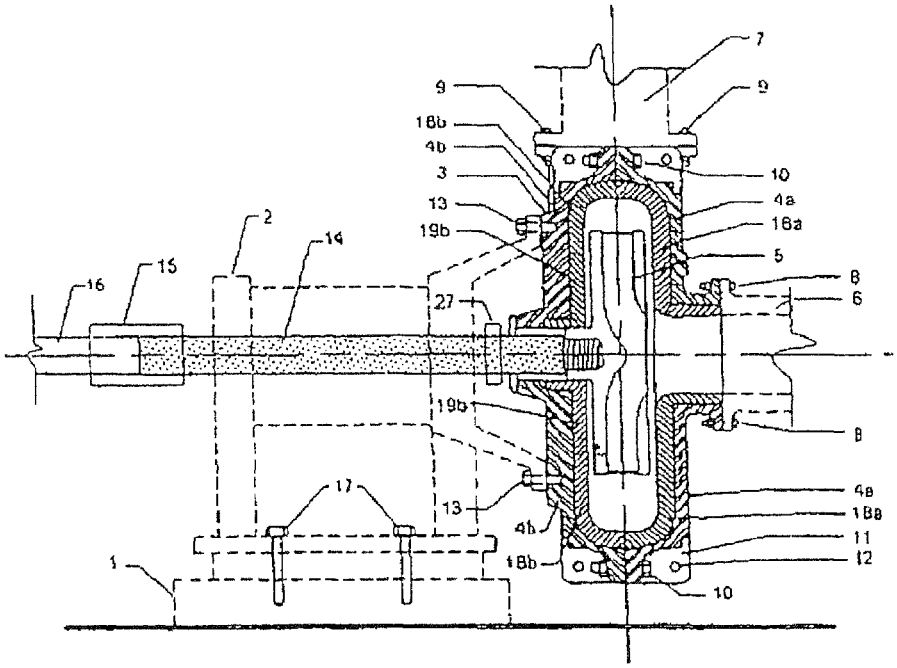
FIG. 3 (Prior Art)
FIG. 3 is a cutaway view in elevation of a slurry pump with sacrificial liners, shown for comparative purposes.
Figure 4:
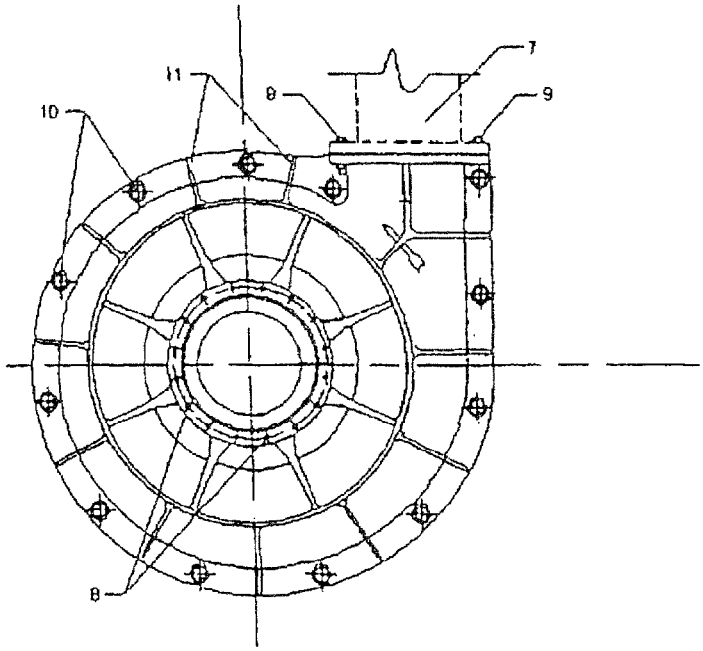
FIG. 4 (Prior Art)
FIG. 4 is a view in elevation of the front face (i.e., suction side) of the pump shown in FIG. 3.

A slurry pump with sacrificial liners, as shown in FIG. 3, differs from the pump illustrated in FIG. 1 in that the inner surfaces of the casing frontal face 4*a* and casing rear face 4*b* have a covering or lining 18*a* and 18*b*, respectively, as shown in FIG. 3. The pump weight may vary between 12 to 30 tonnes depending on the pump size, and including the base 2. Consequently, handling (i.e., raising or moving) the pump requires the use of chain blocks or cranes, for which purpose the wet end comprises flanges 11 having apertures 12 that are located at the outer side of casing frontal face 4*a* and casing rear face 4*b*.

The high rotation speed of the pump demands that there be a precise alignment between the pump shaft 14, the drive shaft 16 and the impeller 5. Thus, when the internal parts or elements of the pump become worn, the servicing of centrifugal pumps in presently and conventionally performed in one of two ways. Repairs are effected either by totally replacing the pump or by replacement of the pump liners and impeller through dismantling the pump in situ.

Total replacement of the pump requires the following procedure, in connection with which reference is made to FIG. 1:

1. Disconnect suction pipe 6 and discharge pipe 7 from the pump casing by removing bolts 8 and 9, respectively;
2. Disconnect coupling 15 to disengage pump shaft 14 from drive shaft 16;
3. Remove bolts 17 which connect the complete pump assembly from its subbase 1;
4. Remove the complete pump assembly from the pump location by means of a chain block or crane and transport the complete pump assembly to repair facility for maintenance;
5. Transport to the pump location a new complete pump assembly by means of chain block or crane;
6. Connect the complete pump assembly to subbase 1 by means of bolts 17;
7. Connect coupling 15 which joins pump shaft 14 and drive shaft 16;
8. Perform precision alignment of pump shaft 14 and drive shaft 16; and
9. Connect suction pipe 6 and discharge pipe 7 to pump by means of bolts 8 and 9, respectively.

The foregoing procedure for replacement of the total pump presents certain disadvantages, namely the fact that it requires costly replacement of the entire pump assembly, including the entire mechanical system, bearing housing, packing gland, lubricating assemblies (not shown in the figures) and the pump shaft 14, resulting in a greater investment cost; the weight to be handled, considering the complete pump assembly, is about twelve to thirty tonnes of which four to ten tonnes corresponds to the weight of base; alignment of the pump shaft to the drive shaft must be extremely accurate to avoid vibration and to prevent equipment damage, and the realignment procedure is an arduous task that requires considerable time; and, the pump replacement procedure takes over eight hours.

Replacement of the worn pump parts with new elastomeric liners and/or a new impeller by dismantling the pump in situ requires the following steps, in connection with which reference is made to FIG. 3:

1. Disconnect suction pipe 6 and discharge pipe 7 from the pump by removing bolts 8 and 9, respectively;
2. Place lifting slings on the pump casing frontal face 4*a;*
3. Open wet end 3 (i.e., disconnect casing frontal face 4*a* from casing rear face 4*b*) by removing bolts 10;
4. Remove casing frontal face 4*a* and store temporarily;
5. Disengage torque release mechanism 27;
6. Secure old impeller 5 with a special lifting device that maintains impeller 5 in a vertical position while allowing rotation of pump shaft 14 to reverse direction for disconnection of the impeller 5 from the pump shaft 14 and to permit removal of the impeller 5;
7. Place lifting slings on the casing rear face 4*b;*
8. Remove bolts 13 which join the casing rear face 4*b* to the pump base 2;
9. Remove the casing rear face 4*b* and store temporarily for removal and replacement of liner 18*b* in casing rear face 4*b;*
10. Reinstall the casing rear face 4*b*, which has been outfitted with a new liner 18*b*, and secure to pump base 2 by means of bolts 13;
11. Install the new impeller 5 by using the special device that keeps the impeller 5 in a centralized vertical position;
12. Re-engage the torque release mechanism 27;
13. Rotate pump shaft 14 in its normal rotational direction for connection of the new impeller 5; and
14. Install the casing frontal face 4*a* in which a new liner 18*a* has been installed, and close the pump (i.e., attach casing frontal face 4*a* to casing rear face 14*b*) by fastening bolts 10.

The foregoing procedure does not require the re-alignment of the pump shaft and drive shaft as required with the total pump replacement procedure; however, it presents the following disadvantages: 1) It requires many steps that take much working time, especially steps 3 and 11; 2) it requires using a special lifting device mounted on a chain block which keeps the impeller in a centralized vertical position for both disconnection and re-connection to the pump shaft; and 3) the total pump wet end liner and impeller replacement procedure takes over eight hours.

The main problem encountered with the conventional procedures of pump replacement or repair, as outlined above, is the time it takes, which causes a drop in production rate or output. Due to the large mineral processing through-put, reduction in the amount of time the pump is off-line has a great impact in the plant productivity and profitability. In the current state of the art there is no procedure to replace slurry pump liners in less than eight hours. This is the technical problem that is solved by the present invention.

Figure 5:
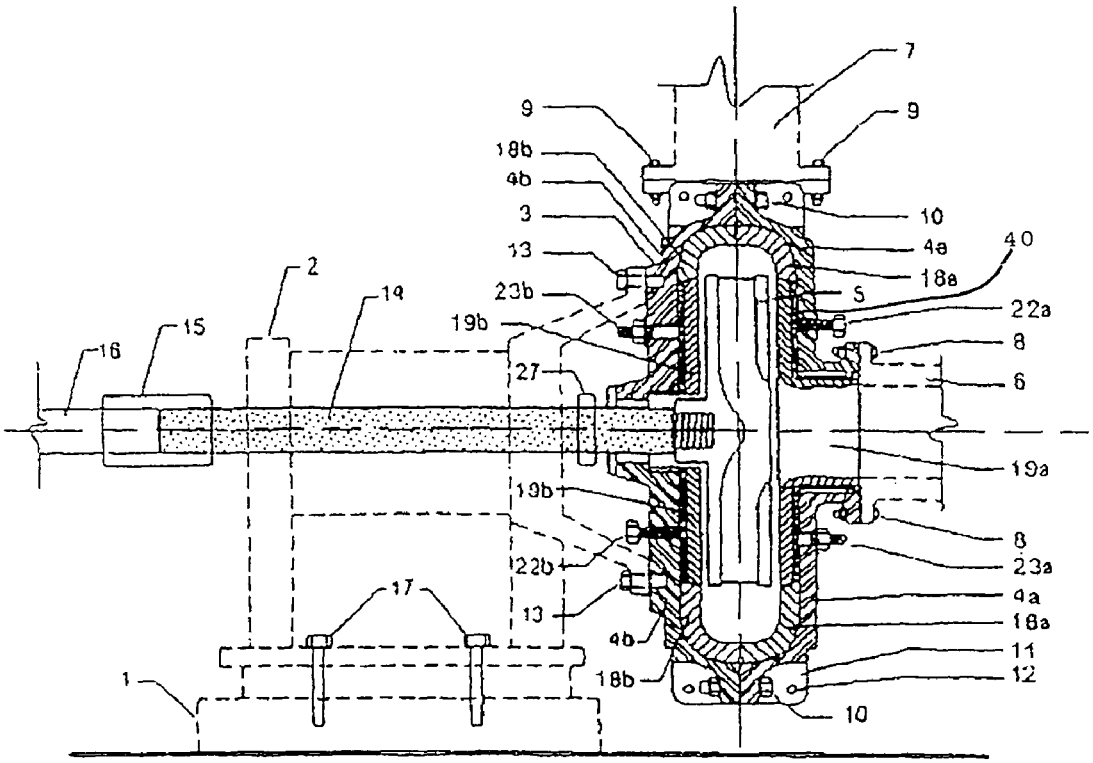
FIG. 5 is a cutaway view in elevation of a slurry pump in a preferred embodiment of the invention.
Figure 6:
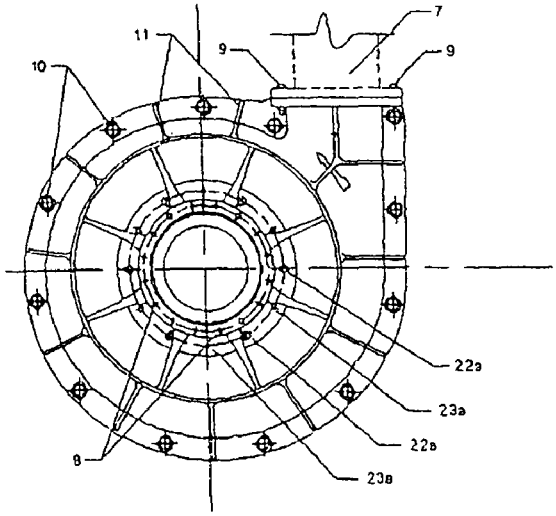
FIG. 6 is a view in elevation of the pump of FIG. 5 showing the front face (i.e., suction side)

FIGS. 5 and 6 illustrate a centrifugal pump having the impeller fixing mechanism of the present invention installed in the pump. Like parts of the centrifugal pump illustrated in FIGS. 5 and 6 are denoted with the same reference numerals as shown in FIGS. 1-4. The present invention comprises an impeller fixing mechanism 40 (best seen in FIGS. 8 and 9) that temporarily fixes the impeller 5 to the casing frontal face 4*a* and casing rear face 4*b* in such a way that the impeller 5 remains immobilized and perfectly centered in the wet end 3, thereby enabling the impeller to be connected to pump shaft 14 without the need for realignment. In other words, the impeller fixing mechanism allows removal of the entire pump wet end assembly 3 from the slurry pump base 2 without the impeller 5 losing its position relative to the pump shaft 14, and no realignment of the impeller 5 to the pump shaft 14 is required, nor is the slurry pump required to be dismantled in situ.

When impeller 5 is fixed and immobilized, the wet end 3 can be removed by removing bolts 13 only, without the need of disconnecting pump shaft 14 from drive shaft 16 (i.e., through disconnection of coupling 15). Consequently, no realignment between the shafts is needed as is the case in the event of total replacement of the pump as previously described. Nor is it necessary to open the slurry pump wet end 3, as required in the case of dismantling the pump in situ as previously described.

One suitable embodiment of the impeller fixing mechanism of the present invention is shown in FIGS. 5-9. FIG. 5 is a cross section view of a centrifugal pump in which is installed the impeller fixing mechanism 40. In a preferred embodiment, the impeller fixing mechanism comprises two elements concentric with the pump shaft 14, the first fixing element 19*a* being attached to the casing frontal face 4*a* on an inside surface thereof, and the second fixing element 19*b* being attached to the casing rear face 4*b* on an inside surface thereof.

Figure 7:
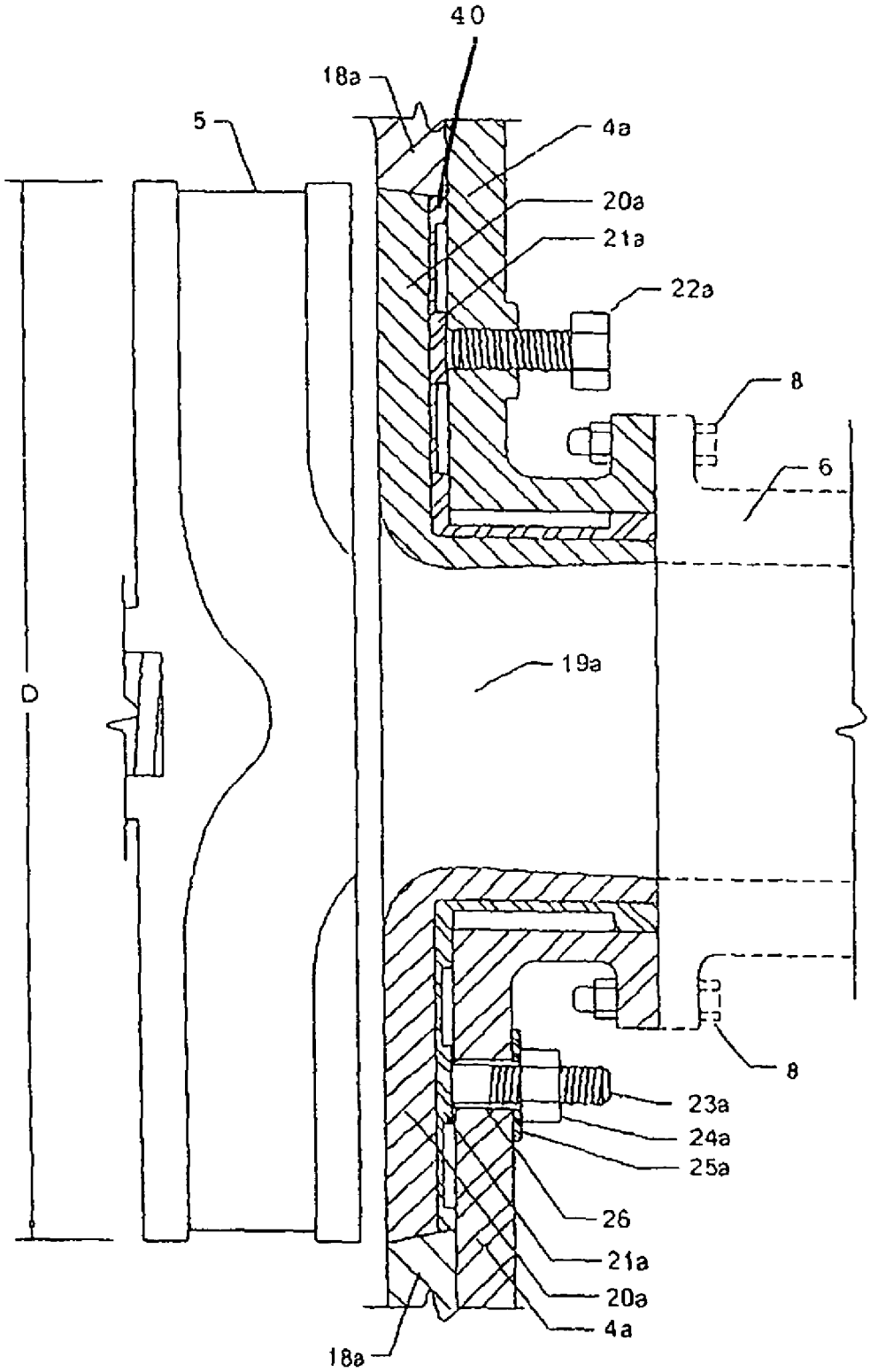
FIG. 7 is an enlarged cutaway view in elevation of a preferred embodiment of the impeller fixing mechanism of the present invention.
Figure 8:
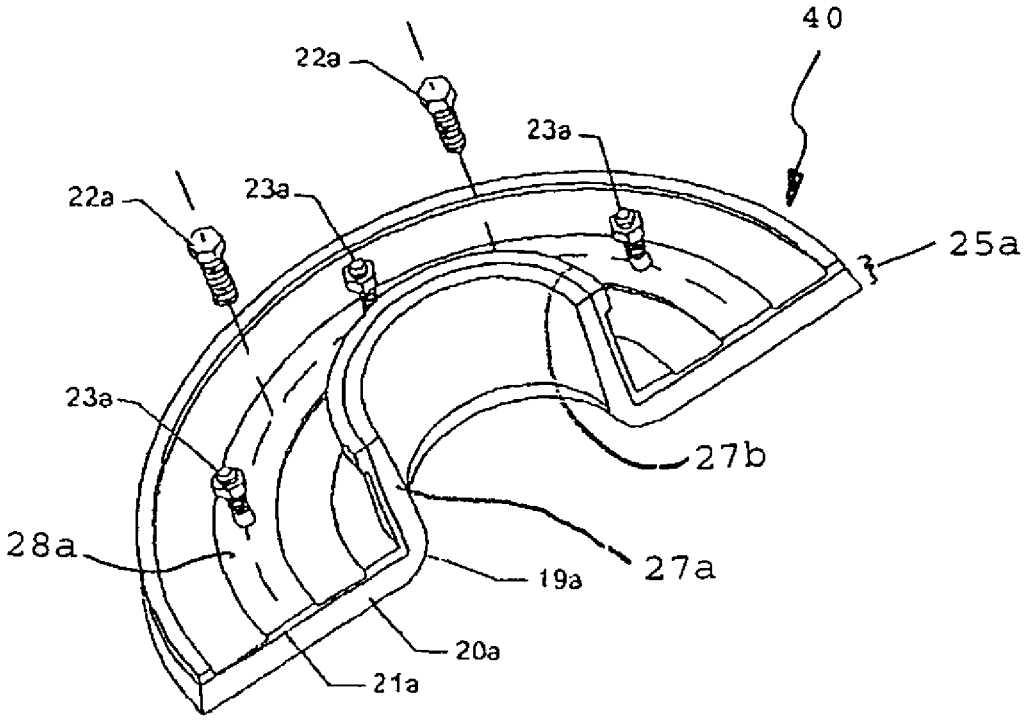
FIG. 8 is a perspective view of a portion of the impeller fixing mechanism corresponding to the front face or suction side of the pump.
Figure 9:
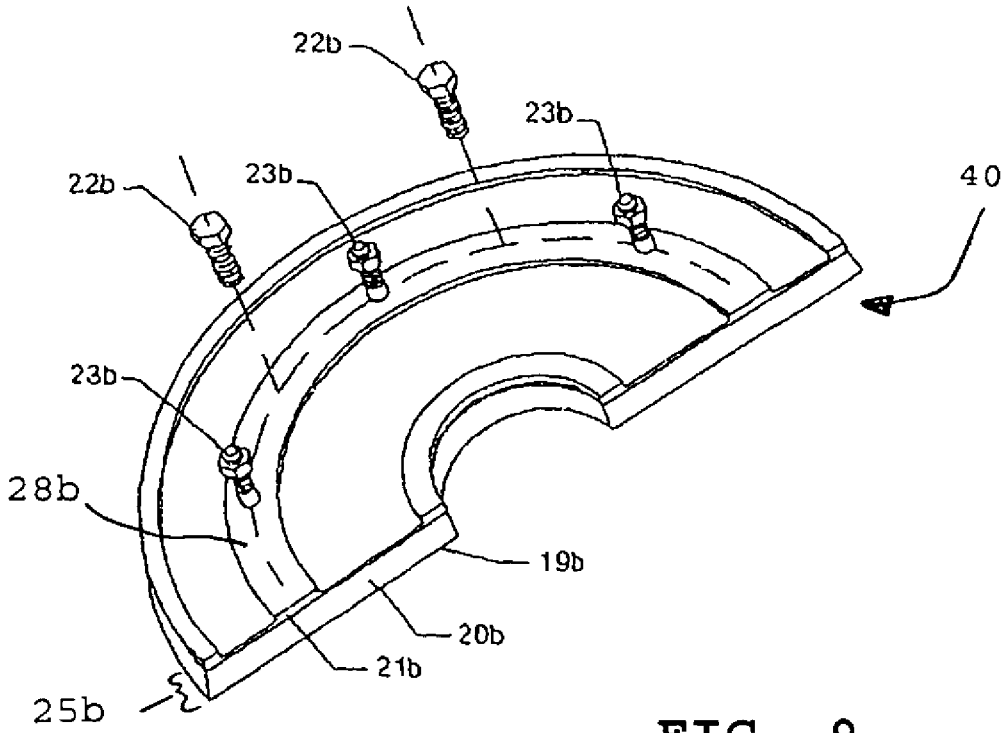
FIG. 9 is a perspective view of a portion of the impeller fixing mechanism corresponding to the rear face or drive side of the pump.

First fixing element 19*a* and second fixing element 19*b*, as better seen in FIGS. 7, 8 and 9, are both annular members that are positioned in the pump concentric to the pump shaft 14. Therefore, there will be a simultaneous and common description of structure of the two fixing elements 19*a* and 19*b*. First fixing element 19*a* and second fixing element 19*b* each comprises a flexible elastomeric member 20*a* and 20*b*, respectively, having a diameter 0.95D to 1.0D, where D is the diameter of the impeller 5. The flexible elastomeric members 20*a* and 20*b* each have a thickness 25*a* and 25*b*, respectively, that may range from about 10 mm to about 25 mm depending on the size of the pump. The thickness 25*a* and 25*b* of the respective elastomeric members 20*a* and 20*b* may be the same or may differ within the specified range.

Each fixing element 19*a* and 19*b* further comprises a stiff backing member 21*a* and 21*b*, respectively, the diameter of which is essentially radially co-extensive with the elastomeric member 20*a* and 20*b*, respectively. The thickness of each stiff backing member 21*a* and 21*b* may range from between about 10 mm to about 30 mm. It should be noted that first fixing element 19*a*, which is positioned in the pump against the casing frontal face 4*a*, as shown in FIG. 7, is configured with an upstanding collar portion 27*a* in the elastomeric member 20*a* and a similar upstanding collar portion 27*b* in the stiff backing member 21*a*. The upstanding collar portion 27*a* and 27*b* is configured to be received in the suction inlet of the pump.

The stiff backing members 21*a* and 21*b* each are configured with axially extending, concentric ribs 28*a* and 28*b*, as shown in FIGS. 8 and 9. The thickness, or axially extended height, of the ribs may range from between about 20 mm to about 50 mm. Therefore, the overall axial thickness of the stiff backing members 21*a*, 21*b* may range from between about 30 mm to about 80 mm.

Tightening bolts 22*a* and 22*b* are provided for positioning through the respective casing faces 4*a* and 4*b* and are screwed into the casing faces 4*a* and 4*b* as shown in FIG. 7. The respective terminal ends of the tightening bolts 22*a* and 22*b* are positioned to contact the rib 28*a*, and 28*b* of the respective stiff backing members 21*a* and 21*b*.

Each of the stiff backing members 21*a* and 21*b* further includes a loosening system consisting of loosening bolts 23*a* and 23*b*, nuts 24*a* and 24*b*, and washers 25*a* and 25*b*. Bolts 23*a* and 23*b* are integrally connected or formed to the stiff backing members 21*a* and 21*b*, respectively, and freely pass through the holes 26*a* and 26*b* in the respective casing faces 4*a* and 4*b* as illustrated in FIG. 7. FIGS. 8 and 9 show the distribution of tightening bolts 22*a*, 22*b* and loosening bolts 23*a*, 23*b*, which are inserted and evenly spaced apart in a concentric circumference about the fixing elements 19*a* and 19*b*, and concentric with the pump shaft 14.

To fix the impeller 5 for effecting a repair of the pump, nuts 24*a* and 24*b* are first loosened, which allows free movement of loosening bolts 23*a* and 23*b*. The tightening bolts 22*a* and 22*b* may then be turned to cause first fixing element 19*a* and second fixing element 19*b* to move, respectively, axially toward impeller 5 until the fixing elements 19*a* and 19*b* have each made contact with and are pressing on the impeller 5 surfaces to "sandwich" the impeller 5 between the fixing elements 19*a*, 19*b*, immobilizing and keeping impeller 5 fixed in a centered position with respect to pump shaft 14.

To unlock or free the impeller 5 again, tightening bolts 22*a* and 22*b* are loosened and nuts 24*a* and 24*b* of loosening bolts 23*a* and 23*b* are rotated to urge the fixing element 19*a*, 19*b* away from the impeller. The tightening bolts 22*a*, 22*b* are then tightened to retain the fixing elements 19*a*, 19*b* in adjoining proximity to the respective casing face 4*a*, 4*b*.

By use of the impeller fixing mechanism of the present invention, the complete pump wet end replacement procedure comprises the following steps:

1. Disconnect suction pipe 6 and discharge pipe 7 from the pump by removing bolts 8 and 9, respectively;
2. Place lifting slings on the entire pump wet end 3;
3. Loosen nuts 25*a* and 25*b* to allow displacement of members 19*a* and 19*b* by tightening bolts 22*a* and 22*b* until members 19*a* and 19*b* make contact with and press on the impeller 5 front and rear faces;
4. Remove bolts 13 that fasten the casing rear face 4*b* to the pump base 2;
5. Disengage the torque release mechanism 27;
6. Rotate pump shaft 14 in its normal reverse rotation direction for disconnection from impeller 5;
7. Remove the wet end 3 and transport it to a repair facility;
8. Position the new wet end furnished with the impeller 5 assembled and restrained in the centralized position by an impeller fixing mechanism 40 and fasten it to base 2 by means of bolts 13;
9. Engage the torque release mechanism 27;
10. Rotate shaft 14 in its normal rotational direction for reconnection to impeller 5; and
11. Release bolts 22*a* and 22*b* to allow movement of members 19*a* and 19*b* away from the impeller 5 by rotating nuts 24*a* and 24*b*, until members 19*a* and 19*b* make contact with faces 4*a* and 4*b*.

The advantages of this procedure which makes use of the impeller fixing mechanism of the present invention preferred over known procedures are a. There is a maximum of plant operating down-time of less than two hours;
b. It does not require disconnection of the pump shaft and drive shaft coupling; and
c. There is no need for realignment of the pump shafts.

The impeller fixing mechanism of the present invention is directed to facilitating repairs to centrifugal pumps and may be adapted to use in any number or variety of pumps. Hence, reference herein to specific details or embodiments of the invention are by way of illustration only and not by way of limitation.

What is claimed is:

1. A method for handling a pump in a pump handling procedure, comprising:

providing a pump comprising:

an outer casing having an inlet and a discharge outlet, a pumping chamber within the outer casing, an impeller mounted within the pumping chamber for rotation about an axis of rotation when in use, the impeller having a surface extending radially from an outer circumferential edge of the impeller toward the axis of rotation of the impeller, a fixing mechanism further comprising a fixing element having a radially-extending surface positioned to hold and engage said radially-extending surface of the impeller and having loosening bolts immovably secured to said fixing element and extending from the fixing element through holes formed in the outer casing, each loosening bolt having a tightening nut operatively associated therewith, and tightening bolts threadedly positioned through said outer casing and positioned to effect contact with said fixing element; and activating the fixing mechanism by operatively turning said tightening nut on each said loosening bolt to effect axial movement, by said loosening bolt, of said fixing element from either a holding position, where the radially-extending portion of the fixing element holds and engages the radially-extending surface of the impeller, or a release position, where the fixing element does not engage the impeller; and maintaining the fixing element in either a holding position or a release position by activating said tightening bolts to provide contact between each said tightening bolt and said fixing element to stabilize the fixing element.

2. A method according to claim 1 wherein, when in use, the pump casing is operatively mounted to a base and the impeller is operatively coupled to a drive shaft, and wherein the pump handling procedure comprises dismounting the pump casing and impeller from the base, the method further including activating the fixing mechanism so as to transfer the fixing mechanism from the release position to the holding position, decoupling at least a part of the drive shaft from the impeller and disconnecting the pump casing from the base.

3. A method according to claim 1 wherein, when in use, the pump casing is operatively connected to a base and the impeller is operatively coupled to a drive shaft, and wherein the pump handling procedure comprises mounting the pump casing and impeller to the base, the method further including positioning the impeller relative to the pump casing and activating the fixing mechanism so as to transfer the fixing mechanism from the release position to the holding position, mounting the pump casing to the base and operatively coupling at least part of the drive shaft to the impeller.

4. A method according to claim 1 wherein, when in use, the pump casing is operatively mounted to a base and the impeller is operatively coupled to a drive shaft, and wherein the pump handling procedure comprises replacing a first pump casing and first impeller with a second pump casing and second impeller, the method further comprising:

activating the fixing mechanism of the first pump casing and first impeller so as to transfer the fixing mechanism from the release position to the holding position;

decoupling at least a part of the drive shaft from the first impeller and disconnecting the first pump casing from the base;

activating the fixing mechanism of the second pump casing and second impeller to axial fix the second impeller relative to the second pump casing;

mounting the second pump casing to the base and operatively coupling at least part of the drive shaft to the second impeller.

5. A method according to claim 1 wherein said fixing mechanism is moved from said holding position to said release position by terminating contact between the tightening bolts and the fixing element by turning the tightening bolts until the tightening bolts are spaced apart from the fixing element, and turning said tightening nuts about said loosening bolts to effect axial movement by said loosening bolts of the fixing element.

* * * * *